US008585360B2

(12) United States Patent
Islam et al.

(10) Patent No.: US 8,585,360 B2
(45) Date of Patent: Nov. 19, 2013

(54) TURBINE VANE NOMINAL AIRFOIL PROFILE

(75) Inventors: Alamgir T. Islam, Oviedo, FL (US); Daniel M. Eshak, Orlando, FL (US); Paul J. Gear, Longwood, FL (US)

(73) Assignee: Siemens Energy, Inc., Orlando, FL (US)

( * ) Notice: Subject to any disclaimer, the term of this patent is extended or adjusted under 35 U.S.C. 154(b) by 709 days.

(21) Appl. No.: 12/878,210

(22) Filed: Sep. 9, 2010

(65) Prior Publication Data

US 2012/0063908 A1 Mar. 15, 2012

(51) Int. Cl.
*F01D 5/14* (2006.01)

(52) U.S. Cl.
USPC ..... 415/191; 416/223 A

(58) Field of Classification Search
USPC ..... 415/191; 416/223 A, 223 R, 243, DIG. 2
See application file for complete search history.

(56) References Cited

U.S. PATENT DOCUMENTS

| | | | | |
|---|---|---|---|---|
| 6,450,770 | B1 | 9/2002 | Wang et al. | |
| 6,461,109 | B1 | 10/2002 | Wedlake et al. | |
| 7,351,038 | B2 | 4/2008 | Girgis et al. | |
| 7,367,779 | B2 | 5/2008 | Girgis et al. | |
| 7,520,728 | B2 | 4/2009 | Sleiman et al. | |
| 7,537,432 | B2 | 5/2009 | Marini et al. | |
| 7,559,749 | B2 | 7/2009 | Kidikian et al. | |
| 7,566,200 | B2 | 7/2009 | Marini et al. | |
| 7,568,890 | B2 | 8/2009 | Findlay et al. | |
| 7,568,891 | B2 | 8/2009 | Mohan et al. | |
| 7,611,326 | B2 | 11/2009 | Trindade et al. | |
| 7,625,183 | B2 | 12/2009 | Tsifourfaris et al. | |
| 2007/0207036 | A1 | 9/2007 | Girgis et al. | |
| 2007/0207037 | A1 | 9/2007 | Girgis et al. | |
| 2008/0056893 | A1* | 3/2008 | Marini et al. | 415/191 |
| 2008/0056894 | A1 | 3/2008 | Tsifourdaris et al. | |
| 2008/0056896 | A1 | 3/2008 | Trindade et al. | |
| 2008/0118360 | A1 | 5/2008 | Findlay et al. | |
| 2008/0118361 | A1 | 5/2008 | Mohan et al. | |
| 2008/0124221 | A1 | 5/2008 | Kidikian et al. | |
| 2008/0124223 | A1 | 5/2008 | Marini et al. | |
| 2008/0273970 | A1 | 11/2008 | Sleiman et al. | |
| 2009/0116967 | A1 | 5/2009 | Sleiman et al. | |
| 2010/0008784 | A1 | 1/2010 | Shafique et al. | |

* cited by examiner

*Primary Examiner* — Edward Look
*Assistant Examiner* — Aaron R Eastman

(57) ABSTRACT

A turbine vane for a turbine machine comprising an intermediate section having a nominal airfoil profile substantially in accordance with Cartesian coordinate values of X, Y and Z set forth in Table I wherein Z is a radial distance along a stacking axis that is normal to a centerline of the turbine machine and contain the X and Y values with Z value beginning at innermost aerodynamic point and the Z values represent a radial height of the vane and the X and Y values define the nominal airfoil profile at each radial height Z.

18 Claims, 3 Drawing Sheets

TURBINE VANE NOMINAL AIRFOIL PROFILE

FIELD OF THE INVENTION

The present invention relates generally to turbines and more specifically to turbine vanes. In particular, embodiments of the invention pertain to improved vane airfoil profiles.

BACKGROUND OF THE INVENTION

In a gas turbine engine, air is pressurized in a compressor then mixed with fuel and burned in a combustor to generate hot combustion gases. These pressurized hot combustion gases are expanded within a turbine section that may include multiple stages of rotary blades. The expanding gases cause the blades to rotate to power an upstream machine such as a generator to produce electricity, or otherwise generate a work load. A turbine stage may include a row of stationary vanes followed by a row of rotating turbine blades, where the turbine blades extract energy from the hot combustion gas for powering the compressor and providing output power as described. The stationary turbine vanes control the gas flow between successive turbine blades. In particular, the turbine vanes having intricately designed airfoil profiles to redirect gas flow exiting turbine blades, while minimizing temperature and pressure loss of the expanding gas.

One of the primary demands of turbine machine is maximizing the efficiency of the turbine operation. That is, generating more power or energy using less fuel. Various components of a turbine, for example vanes and blades, are constantly upgraded or modified to meet these demands. These turbine vanes and turbine blades are being constantly redesigned to meet the demands associated with the technological advances of turbines. More specifically, the airfoil profile of vanes and blades may be reconfigured to enhance the efficiency of turbine operations. By way of example, existing turbine machines that have been in operation over a number of years, and in some instance for decades, are often upgraded, which may result in the turbine vanes or blades airfoil profiles shifting away from an optimum aerodynamic design point. Accordingly, a need exists for an improved airfoil profile of a turbine vane, and especially a second stage turbine vane airfoil profile, to improve the aerodynamic efficiency of a turbine section of a turbine machine.

BRIEF DESCRIPTION OF THE DRAWINGS

The invention is explained in the following description in view of the drawings that show.

DETAILED DESCRIPTION OF THE INVENTION

Figure 1:
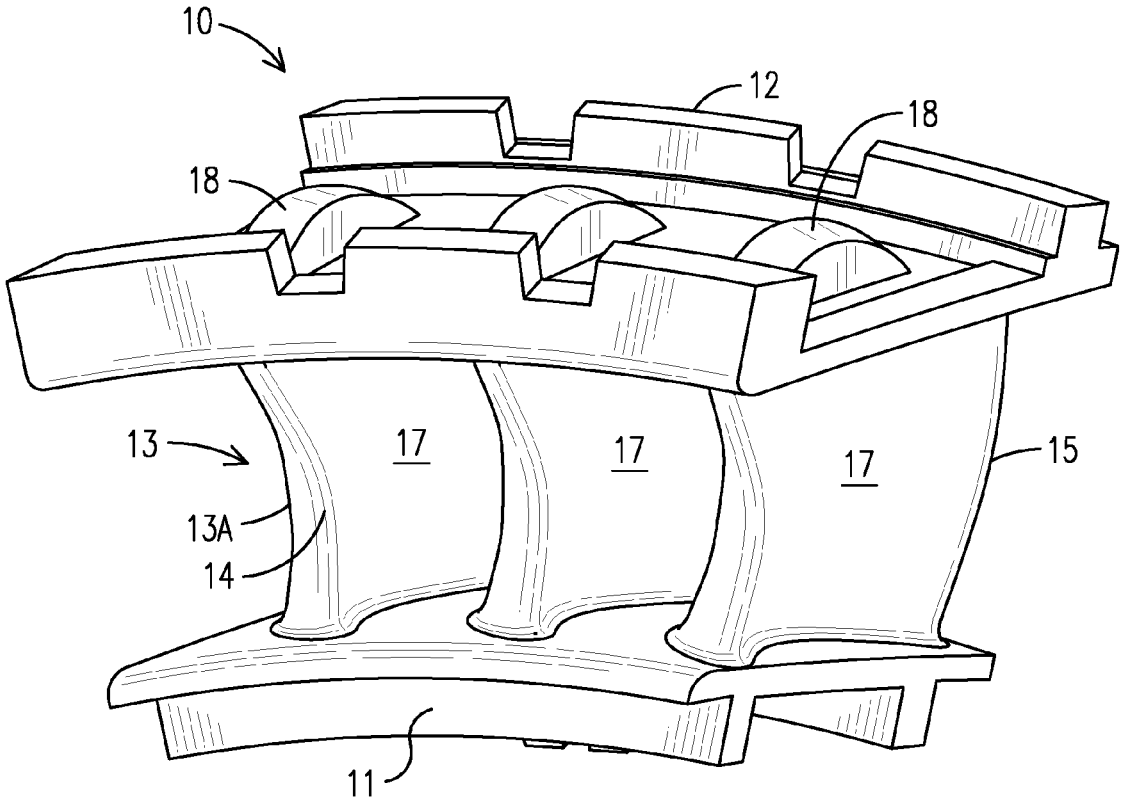
FIG. 1 is a perspective view of a turbine vane.
Figure 6:
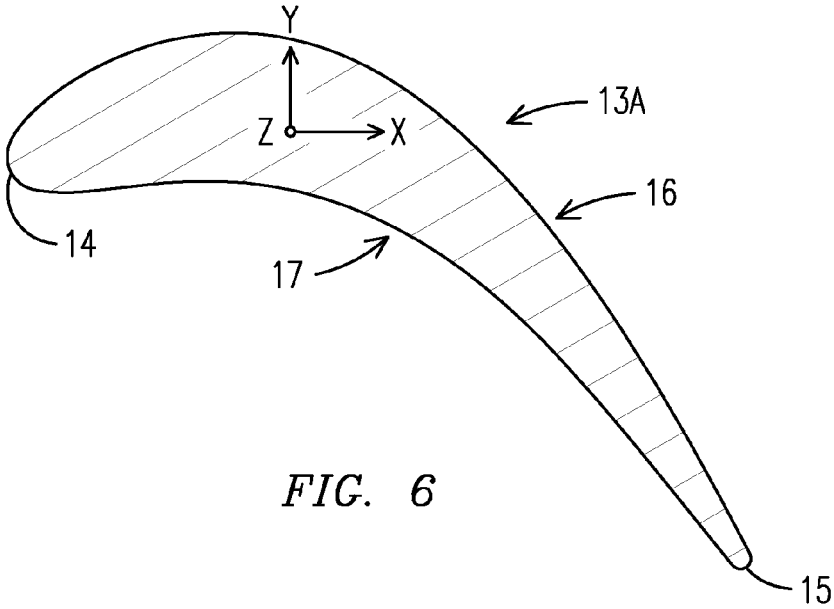
FIG. 6 is a sectional view of the airfoil taken along lines 6-6 of FIG. 2.
Figure 2:
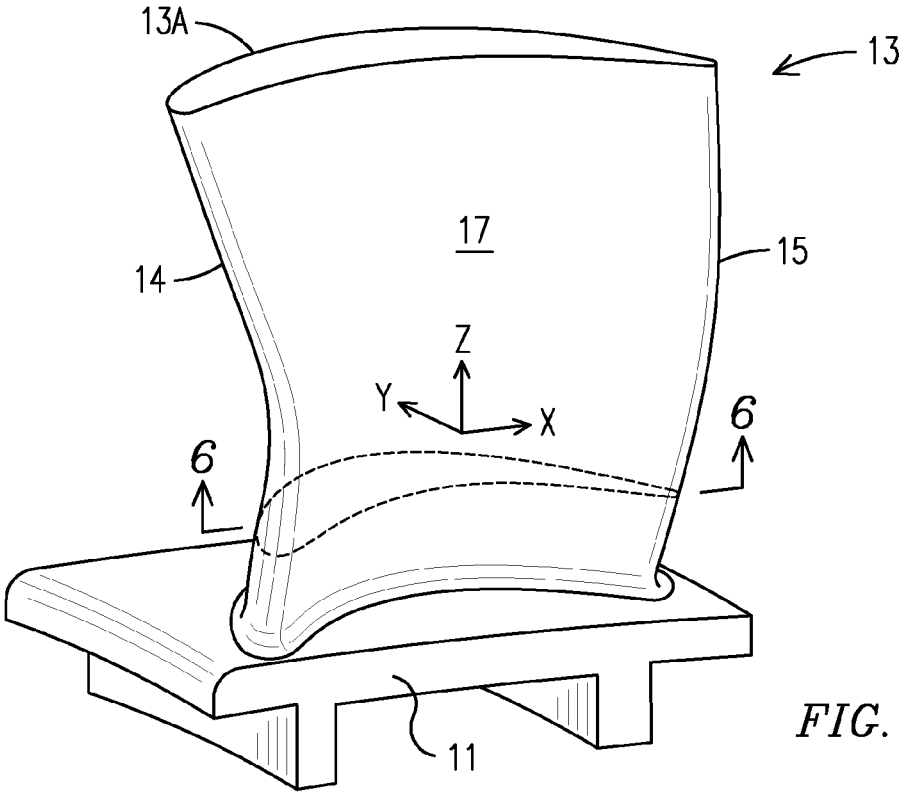
FIG. 2 is an elevational side view of the pressure side of an airfoil for a turbine vane.
Figure 3:
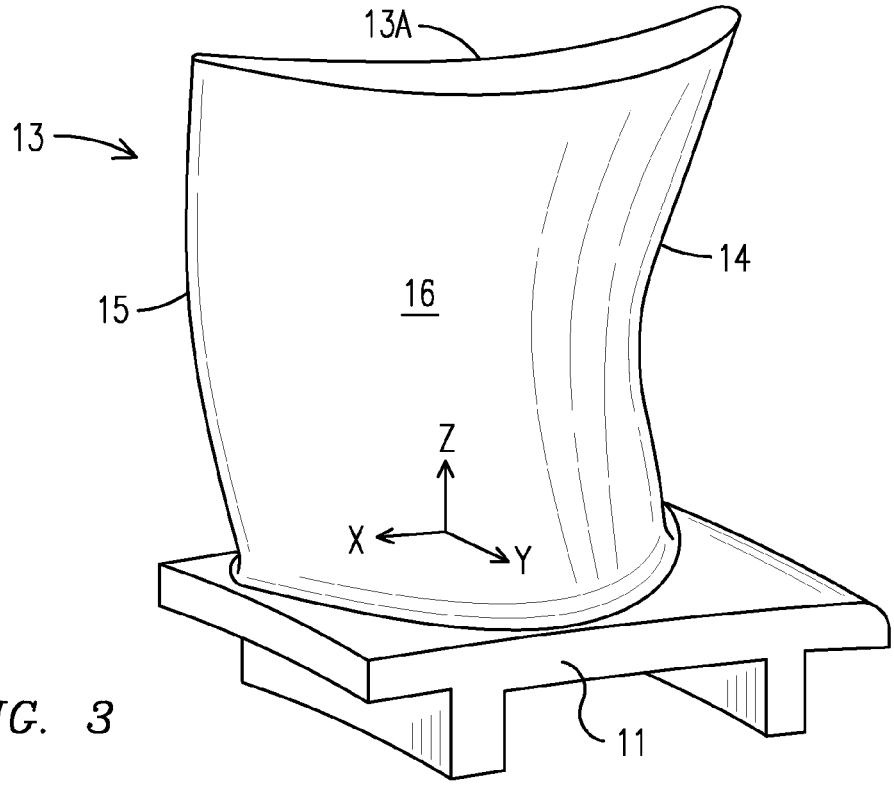
FIG. 3 is an elevational view of the suction side of the airfoil.
Figure 4:
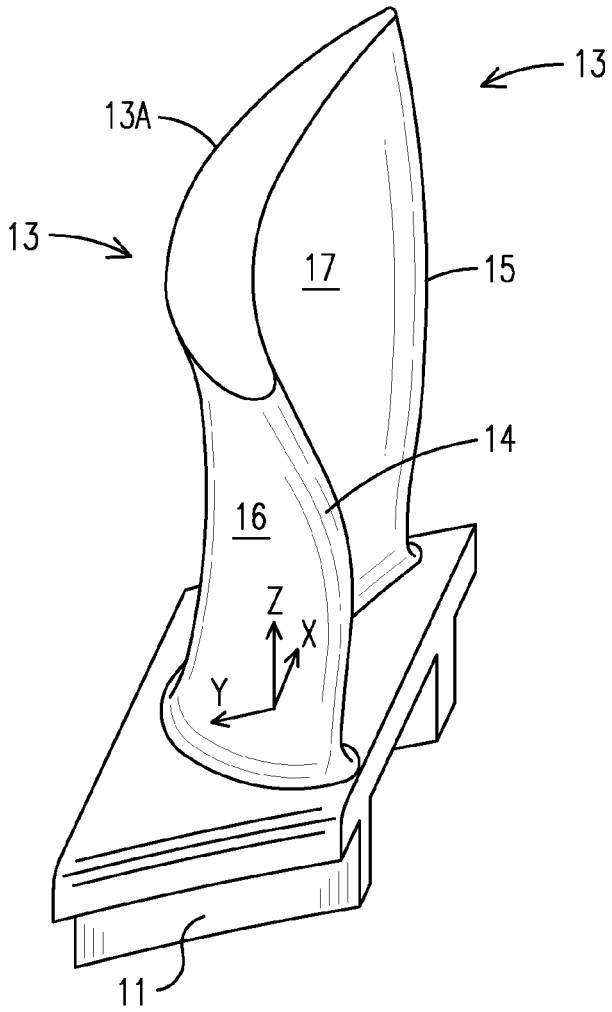
FIG. 4 is a top perspective leading edge view of the airfoil.
Figure 5:
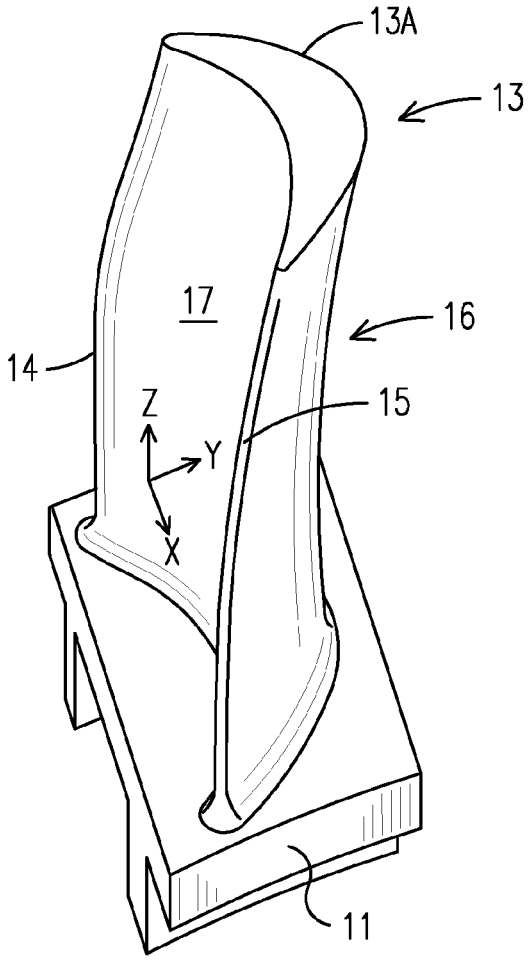
FIG. 5 is a top perspective trailing edge view of the airfoil.

Referring now to FIG. 1 there is illustrated a section of a turbine vane block 10 for a turbine machine that includes a plurality of stationary turbine vanes 13 mounted to an inner shroud 11 and outer shroud 12. As known to those skilled in the art a turbine may include multiple stages including a plurality of turbine rotary blades that rotate about a rotary axis of the turbine machine to produce energy from hot expanding pressurized gases flowing over the turbine rotary blades. The stationary vane blocks are disposed between rotating turbine blades to control and direct the flow of the hot expanding pressurized gas between respective turbine blades.

With respect to FIGS. 2 through 6, the airfoil configuration for a stationary vane 13 is shown having an external contour that improves the performance of a turbine machine especially in terms of improving the consumption of fuel by the turbine machine. The vane 13 includes an intermediate section 13A (also referred to as an "airfoil section") disposed between the shrouds 11 and 12, that controls gas flow through the vane block 10 and to an adjacent rotating turbine blade block (not shown). The intermediate section 13A of the vane 13 includes a leading edge 14 disposed towards an ingress of gas flow across the vane block 10 and a trailing edge 15 disposed towards an egress of the gas flow. As shown, the airfoil shape has an overall concave/convex geometric configuration including a suction side 16 and a pressure side 17 to control gas flow through the vane block 10. As known to those skilled in the art, a root (not shown) is integrally formed with each vane 13 and imbedded in the inner shroud 11, and a tip 18 of the airfoil is mounted to the outer shroud 12. However, other mechanisms or methods may be used to mount a vane to shrouds 11 and 12 that are well known to those skilled in the art.

Also shown in FIGS. 2 through 6 are X, Y and Z axes that represent a Cartesian coordinate system and the orientation of an airfoil relative to a rotary axis or centerline of the turbine machine not shown. Cartesian coordinate values are set forth in Table I below. The Cartesian coordinate system includes the orthogonally disposed X, Y and Z axes wherein the X axis is disposed substantially parallel to the centerline or rotary axis of a turbine machine; and, the Z axis represents a radial height of the intermediate section 13A of the vane 13 and is disposed normal to a plane defined by the X and Y axis, or perpendicular to the centerline of the turbine machine. That is, the Z coordinate represents a radial height of the vane at designated cross sections, and X and Y coordinates represent the nominal airfoil profile at each radial height coordinate. As shown in Table I, the radial height coordinate Z begins at 0.0000, which is at or adjacent to an innermost point of an airfoil point relative to the inner shroud 11, or an innermost aerodynamic point of the intermediate section 13A. As one skilled in the art will appreciate, the airfoil profile can be linearly scaled up or down as a function of the same constant or number. Scaling up or down will provide the same airfoil profile vanes of different sizes. A scaled version of the coordinates of Table I would be represented by the X and Y coordinate values multiplied by the same number or constant.

In an embodiment, the airfoil configuration represented in the FIGS. 2 through 6 and as set forth Table I, may be used for a stationary vane in a second stage turbine vane block, and can be incorporated into existing turbine designs to improve the efficiency of such mature machines that are upgraded. The airfoil design described herein has lower pressure and temperature losses at the various locations on the intermediate section 13A vane 13 including lower profile, trailing edge and secondary losses. This airfoil design ideally increases aerodynamic efficiency and firing temperatures using less cooling air for turbine machine operations.

The airfoil profile or contour of the intermediate section 13A of vane 13 introduces a bowed stacking of eleven sections taken along the Z axis. As shown in Table I, there are eleven different Z coordinate values provided at nineteen (19)

millimeter (mm) height increments. Each of the X, Y and Z coordinate values are provided to four decimal places. The span of the airfoil profile or the airfoil section 13A has an overall smooth contour. The X and Y values define a set of points for each Z value which when connected by smooth continuing arcs define an airfoil profile of the intermediate section of the vane, and the profile sections at the Z heights are joined smoothly with one another to form an airfoil shape of the intermediate portion.

An uncoated vane will have a nominal airfoil profile tolerance of ±2.5 mm normal to any airfoil surface location thereby defining an airfoil profile range at any such surface location. Any manufacturing tolerances, thickness of coatings etc., are in addition to the described profile tolerance. In addition, the profile tolerance may include a ±1° of rotation around an airfoil stacking axis or the Z axis of the Cartesian coordinate system.

The Cartesian coordinate values set forth in Table I are provided in millimeters and define an embodiment of the nominal airfoil profile for the intermediate section 13A of stationary vane 13.

TABLE I

| X | Y | Z |
|---|---|---|
| 64.4104 | −68.9416 | 0.0000 |
| 60.8336 | −60.0690 | 0.0000 |
| 57.1607 | −51.2357 | 0.0000 |
| 53.3563 | −42.4583 | 0.0000 |
| 49.3678 | −33.7631 | 0.0000 |
| 45.1322 | −25.1858 | 0.0000 |
| 40.5900 | −16.7671 | 0.0000 |
| 35.6962 | −8.5480 | 0.0000 |
| 30.4042 | −0.5799 | 0.0000 |
| 24.6411 | 7.0536 | 0.0000 |
| 18.2886 | 14.2021 | 0.0000 |
| 11.2360 | 20.6575 | 0.0000 |
| 3.3820 | 26.1032 | 0.0000 |
| −5.2758 | 30.1409 | 0.0000 |
| −14.5426 | 32.4525 | 0.0000 |
| −24.0837 | 32.8462 | 0.0000 |
| −33.4906 | 31.2118 | 0.0000 |
| −42.3339 | 27.6102 | 0.0000 |
| −50.2290 | 22.2392 | 0.0000 |
| −56.8114 | 15.3230 | 0.0000 |
| −61.4724 | 7.0146 | 0.0000 |
| −61.7370 | 5.9144 | 0.0000 |
| −61.8053 | 4.7848 | 0.0000 |
| −61.6760 | 3.6606 | 0.0000 |
| −61.3544 | 2.5755 | 0.0000 |
| −60.8562 | 1.5593 | 0.0000 |
| −60.1964 | 0.6398 | 0.0000 |
| −59.3910 | −0.1553 | 0.0000 |
| −58.4611 | −0.8002 | 0.0000 |
| −57.4335 | −1.2740 | 0.0000 |
| −56.3390 | −1.5616 | 0.0000 |
| −49.0323 | −0.9818 | 0.0000 |
| −41.8055 | 0.4720 | 0.0000 |
| −34.4880 | 1.3419 | 0.0000 |
| −27.1199 | 1.4155 | 0.0000 |
| −19.7908 | 0.6574 | 0.0000 |
| −12.6019 | −0.9562 | 0.0000 |
| −5.6566 | −3.4163 | 0.0000 |
| 0.9721 | −6.6347 | 0.0000 |
| 7.2410 | −10.5090 | 0.0000 |
| 13.1427 | −14.9239 | 0.0000 |
| 18.7096 | −19.7551 | 0.0000 |
| 23.9993 | −24.8891 | 0.0000 |
| 29.0742 | −30.2361 | 0.0000 |
| 33.9819 | −35.7372 | 0.0000 |
| 38.7589 | −41.3522 | 0.0000 |
| 43.4194 | −47.0643 | 0.0000 |
| 47.9739 | −52.8613 | 0.0000 |
| 52.4167 | −58.7443 | 0.0000 |
| 56.7346 | −64.7195 | 0.0000 |

TABLE I-continued

| X | Y | Z |
|---|---|---|
| 60.9237 | −70.7859 | 0.0000 |
| 61.8121 | −71.5061 | 0.0000 |
| 62.9488 | −71.6174 | 0.0000 |
| 63.9581 | −71.0835 | 0.0000 |
| 64.5058 | −70.0813 | 0.0000 |
| 66.1876 | −72.9188 | 19.0000 |
| 62.4977 | −64.0813 | 19.0000 |
| 58.7062 | −55.2870 | 19.0000 |
| 54.7855 | −46.5496 | 19.0000 |
| 50.6881 | −37.8938 | 19.0000 |
| 46.3518 | −29.3553 | 19.0000 |
| 41.7186 | −20.9745 | 19.0000 |
| 36.7378 | −12.7957 | 19.0000 |
| 31.3565 | −4.8752 | 19.0000 |
| 25.5035 | 2.7026 | 19.0000 |
| 19.0799 | 9.8015 | 19.0000 |
| 11.9739 | 16.2141 | 19.0000 |
| 4.1091 | 21.6645 | 19.0000 |
| −4.5109 | 25.8099 | 19.0000 |
| −13.7448 | 28.2899 | 19.0000 |
| −23.2885 | 28.8376 | 19.0000 |
| −32.7379 | 27.3908 | 19.0000 |
| −41.6927 | 24.0424 | 19.0000 |
| −49.7910 | 18.9608 | 19.0000 |
| −56.6458 | 12.3016 | 19.0000 |
| −61.4731 | 4.0859 | 19.0000 |
| −61.7430 | 2.9944 | 19.0000 |
| −61.8181 | 1.8724 | 19.0000 |
| −61.6966 | 0.7545 | 19.0000 |
| −61.3835 | −0.3256 | 19.0000 |
| −60.8944 | −1.3383 | 19.0000 |
| −60.2437 | −2.2555 | 19.0000 |
| −59.4471 | −3.0492 | 19.0000 |
| −58.5256 | −3.6937 | 19.0000 |
| −57.5063 | −4.1685 | 19.0000 |
| −56.4197 | −4.4578 | 19.0000 |
| −48.9741 | −4.3216 | 19.0000 |
| −41.5644 | −3.3466 | 19.0000 |
| −34.1219 | −2.6835 | 19.0000 |
| −26.6511 | −2.6400 | 19.0000 |
| −19.2117 | −3.3198 | 19.0000 |
| −11.8840 | −4.7710 | 19.0000 |
| −4.7551 | −7.0027 | 19.0000 |
| 2.0974 | −9.9768 | 19.0000 |
| 8.6131 | −13.6314 | 19.0000 |
| 14.7628 | −17.8740 | 19.0000 |
| 20.5456 | −22.6056 | 19.0000 |
| 25.9876 | −27.7262 | 19.0000 |
| 31.1322 | −33.1462 | 19.0000 |
| 36.0295 | −38.7910 | 19.0000 |
| 40.7350 | −44.5969 | 19.0000 |
| 45.2969 | −50.5165 | 19.0000 |
| 49.7522 | −56.5168 | 19.0000 |
| 54.1308 | −62.5733 | 19.0000 |
| 58.4500 | −68.6724 | 19.0000 |
| 62.7230 | −74.8039 | 19.0000 |
| 63.6198 | −75.5145 | 19.0000 |
| 64.7581 | −75.6128 | 19.0000 |
| 65.7614 | −75.0668 | 19.0000 |
| 66.2972 | −74.0577 | 19.0000 |
| 68.0311 | −76.5227 | 38.0000 |
| 64.2814 | −67.7683 | 38.0000 |
| 60.4216 | −59.0620 | 38.0000 |
| 56.4273 | −50.4166 | 38.0000 |
| 52.2630 | −41.8519 | 38.0000 |
| 47.8714 | −33.4017 | 38.0000 |
| 43.1894 | −25.1091 | 38.0000 |
| 38.1543 | −17.0264 | 38.0000 |
| 32.7073 | −9.2158 | 38.0000 |
| 26.7899 | −1.7560 | 38.0000 |
| 20.3238 | 5.2321 | 38.0000 |
| 13.1963 | 11.5409 | 38.0000 |
| 5.3246 | 16.8871 | 38.0000 |
| −3.2829 | 20.9357 | 38.0000 |
| −12.4737 | 23.3766 | 38.0000 |
| −21.9609 | 24.0206 | 38.0000 |
| −31.3994 | 22.8601 | 38.0000 |
| −40.4634 | 19.9809 | 38.0000 |

TABLE I-continued

| X | Y | Z |
|---|---|---|
| −48.8391 | 15.4780 | 38.0000 |
| −56.1452 | 9.3981 | 38.0000 |
| −61.4111 | 1.5429 | 38.0000 |
| −61.6922 | 0.4667 | 38.0000 |
| −61.7815 | −0.6421 | 38.0000 |
| −61.6769 | −1.7496 | 38.0000 |
| −61.3826 | −2.8224 | 38.0000 |
| −60.9135 | −3.8313 | 38.0000 |
| −60.2840 | −4.7486 | 38.0000 |
| −59.5090 | −5.5467 | 38.0000 |
| −58.6085 | −6.1998 | 38.0000 |
| −57.6081 | −6.6862 | 38.0000 |
| −56.5383 | −6.9910 | 38.0000 |
| −48.9671 | −7.3781 | 38.0000 |
| −41.3930 | −6.7739 | 38.0000 |
| −33.8133 | −6.2491 | 38.0000 |
| −26.2165 | −6.2454 | 38.0000 |
| −18.6472 | −6.8855 | 38.0000 |
| −11.1647 | −8.1948 | 38.0000 |
| −3.8321 | −10.1783 | 38.0000 |
| 3.2825 | −12.8391 | 38.0000 |
| 10.1098 | −16.1685 | 38.0000 |
| 16.5878 | −20.1351 | 38.0000 |
| 22.6644 | −24.6931 | 38.0000 |
| 28.3161 | −29.7691 | 38.0000 |
| 33.5528 | −35.2731 | 38.0000 |
| 38.4268 | −41.1015 | 38.0000 |
| 43.0139 | −47.1589 | 38.0000 |
| 47.4075 | −53.3584 | 38.0000 |
| 51.6972 | −59.6306 | 38.0000 |
| 55.9593 | −65.9215 | 38.0000 |
| 60.2432 | −72.1976 | 38.0000 |
| 64.5815 | −78.4362 | 38.0000 |
| 65.4840 | −79.1409 | 38.0000 |
| 66.6240 | −79.2305 | 38.0000 |
| 67.6237 | −78.6759 | 38.0000 |
| 68.1511 | −77.6614 | 38.0000 |
| 69.6587 | −79.8174 | 57.0000 |
| 65.7988 | −71.0580 | 57.0000 |
| 61.8270 | −62.3488 | 57.0000 |
| 57.7162 | −53.7044 | 57.0000 |
| 53.4348 | −45.1433 | 57.0000 |
| 48.9319 | −36.6967 | 57.0000 |
| 44.1463 | −28.4073 | 57.0000 |
| 39.0136 | −20.3286 | 57.0000 |
| 33.4748 | −12.5232 | 57.0000 |
| 27.4768 | −5.0654 | 57.0000 |
| 20.9500 | 1.9329 | 57.0000 |
| 13.7882 | 8.2766 | 57.0000 |
| 5.8922 | 13.6734 | 57.0000 |
| −2.7519 | 17.7579 | 57.0000 |
| −11.9816 | 20.2440 | 57.0000 |
| −21.5110 | 20.9880 | 57.0000 |
| −31.0124 | 19.9474 | 57.0000 |
| −40.1630 | 17.1829 | 57.0000 |
| −48.6736 | 12.8293 | 57.0000 |
| −56.2511 | 7.0052 | 57.0000 |
| −61.8030 | −0.6891 | 57.0000 |
| −62.0879 | −1.7485 | 57.0000 |
| −62.1850 | −2.8413 | 57.0000 |
| −62.0920 | −3.9345 | 57.0000 |
| −61.8139 | −4.9958 | 57.0000 |
| −61.3644 | −5.9967 | 57.0000 |
| −60.7557 | −6.9096 | 57.0000 |
| −60.0021 | −7.7069 | 57.0000 |
| −59.1236 | −8.3641 | 57.0000 |
| −58.1462 | −8.8624 | 57.0000 |
| −57.0974 | −9.1842 | 57.0000 |
| −49.4166 | −9.9549 | 57.0000 |
| −41.7014 | −9.4596 | 57.0000 |
| −33.9939 | −8.8274 | 57.0000 |
| −26.2627 | −8.7180 | 57.0000 |
| −18.5506 | −9.2676 | 57.0000 |
| −10.9173 | −10.4957 | 57.0000 |
| −3.4284 | −12.4165 | 57.0000 |
| 3.8460 | −15.0345 | 57.0000 |
| 10.8300 | −18.3497 | 57.0000 |
| 17.4469 | −22.3475 | 57.0000 |

TABLE I-continued

| X | Y | Z |
|---|---|---|
| 23.6333 | −26.9841 | 57.0000 |
| 29.3637 | −32.1744 | 57.0000 |
| 34.6550 | −37.8129 | 57.0000 |
| 39.5741 | −43.7798 | 57.0000 |
| 44.2116 | −49.9687 | 57.0000 |
| 48.6671 | −56.2903 | 57.0000 |
| 53.0335 | −62.6739 | 57.0000 |
| 57.3847 | −69.0679 | 57.0000 |
| 61.7699 | −75.4386 | 57.0000 |
| 66.2246 | −81.7609 | 57.0000 |
| 67.1333 | −82.4595 | 57.0000 |
| 68.2751 | −82.5400 | 57.0000 |
| 69.2710 | −81.9764 | 57.0000 |
| 69.7898 | −80.9561 | 57.0000 |
| 71.1669 | −82.4788 | 76.0000 |
| 67.1421 | −73.6248 | 76.0000 |
| 63.0060 | −64.8224 | 76.0000 |
| 58.7280 | −56.0880 | 76.0000 |
| 54.2699 | −47.4444 | 76.0000 |
| 49.5872 | −38.9204 | 76.0000 |
| 44.6315 | −30.5525 | 76.0000 |
| 39.3462 | −22.3889 | 76.0000 |
| 33.6744 | −14.4895 | 76.0000 |
| 27.5585 | −6.9292 | 76.0000 |
| 20.9308 | 0.1853 | 76.0000 |
| 13.6943 | 6.6772 | 76.0000 |
| 5.7557 | 12.2836 | 76.0000 |
| −2.9256 | 16.6439 | 76.0000 |
| −12.2386 | 19.3967 | 76.0000 |
| −21.9066 | 20.2966 | 76.0000 |
| −31.5613 | 19.2630 | 76.0000 |
| −40.8374 | 16.3876 | 76.0000 |
| −49.4601 | 11.9135 | 76.0000 |
| −57.2051 | 6.0532 | 76.0000 |
| −62.9169 | −1.7093 | 76.0000 |
| −63.2017 | −2.7511 | 76.0000 |
| −63.3032 | −3.8265 | 76.0000 |
| −63.2212 | −4.9035 | 76.0000 |
| −62.9593 | −5.9514 | 76.0000 |
| −62.5300 | −6.9426 | 76.0000 |
| −61.9445 | −7.8504 | 76.0000 |
| −61.2156 | −8.6475 | 76.0000 |
| −60.3626 | −9.3100 | 76.0000 |
| −59.4116 | −9.8224 | 76.0000 |
| −58.3872 | −10.1641 | 76.0000 |
| −50.5608 | −11.0746 | 76.0000 |
| −42.6881 | −10.5160 | 76.0000 |
| −34.8336 | −9.7027 | 76.0000 |
| −26.9437 | −9.4381 | 76.0000 |
| −19.0649 | −9.9238 | 76.0000 |
| −11.2775 | −11.2131 | 76.0000 |
| −3.6686 | −13.3133 | 76.0000 |
| 3.6803 | −16.1944 | 76.0000 |
| 10.6920 | −19.8198 | 76.0000 |
| 17.3038 | −24.1323 | 76.0000 |
| 23.4812 | −29.0477 | 76.0000 |
| 29.2349 | −34.4540 | 76.0000 |
| 34.6120 | −40.2361 | 76.0000 |
| 39.6883 | −46.2846 | 76.0000 |
| 44.5528 | −52.5052 | 76.0000 |
| 49.2802 | −58.8308 | 76.0000 |
| 53.9231 | −65.2187 | 76.0000 |
| 58.5282 | −71.6340 | 76.0000 |
| 63.1290 | −78.0524 | 76.0000 |
| 67.7514 | −84.4553 | 76.0000 |
| 68.6668 | −85.1468 | 76.0000 |
| 69.8102 | −85.2170 | 76.0000 |
| 70.8015 | −84.6434 | 76.0000 |
| 71.3103 | −83.6170 | 76.0000 |
| 72.8097 | −84.0554 | 95.0000 |
| 68.6612 | −75.1554 | 95.0000 |
| 64.3997 | −66.3090 | 95.0000 |
| 59.9901 | −57.5356 | 95.0000 |
| 55.3916 | −48.8597 | 95.0000 |
| 50.5661 | −40.3082 | 95.0000 |
| 45.4745 | −31.9125 | 95.0000 |
| 40.0685 | −23.7161 | 95.0000 |
| 34.2936 | −15.7756 | 95.0000 |

TABLE I-continued

| X | Y | Z |
|---|---|---|
| 28.0845 | −8.1706 | 95.0000 |
| 21.3688 | −1.0100 | 95.0000 |
| 14.0573 | 5.5386 | 95.0000 |
| 6.0621 | 11.2282 | 95.0000 |
| −2.6523 | 15.7317 | 95.0000 |
| −11.9997 | 18.6952 | 95.0000 |
| −21.7321 | 19.8866 | 95.0000 |
| −31.5181 | 19.2637 | 95.0000 |
| −41.0437 | 16.9293 | 95.0000 |
| −50.0604 | 13.0674 | 95.0000 |
| −58.2785 | 7.7204 | 95.0000 |
| −64.5302 | 0.2814 | 95.0000 |
| −64.8186 | −0.7366 | 95.0000 |
| −64.9302 | −1.7890 | 95.0000 |
| −64.8675 | −2.8454 | 95.0000 |
| −64.6288 | −3.8764 | 95.0000 |
| −64.2265 | −4.8554 | 95.0000 |
| −63.6742 | −5.7582 | 95.0000 |
| −62.9836 | −6.5601 | 95.0000 |
| −62.1705 | −7.2374 | 95.0000 |
| −61.2549 | −7.7681 | 95.0000 |
| −60.2622 | −8.1343 | 95.0000 |
| −52.2274 | −9.0539 | 95.0000 |
| −44.1282 | −8.6735 | 95.0000 |
| −36.0353 | −8.1486 | 95.0000 |
| −27.9275 | −8.0931 | 95.0000 |
| −19.8519 | −8.8006 | 95.0000 |
| −11.9012 | −10.3801 | 95.0000 |
| −4.1680 | −12.8116 | 95.0000 |
| 3.2752 | −16.0240 | 95.0000 |
| 10.3705 | −19.9460 | 95.0000 |
| 17.0793 | −24.4986 | 95.0000 |
| 23.3869 | −29.5934 | 95.0000 |
| 29.3096 | −35.1317 | 95.0000 |
| 34.8883 | −41.0171 | 95.0000 |
| 40.1822 | −47.1605 | 95.0000 |
| 45.2611 | −53.4831 | 95.0000 |
| 50.1920 | −59.9221 | 95.0000 |
| 55.0310 | −66.4305 | 95.0000 |
| 59.8307 | −72.9680 | 95.0000 |
| 64.6185 | −79.5141 | 95.0000 |
| 69.4093 | −86.0581 | 95.0000 |
| 70.3299 | −86.7445 | 95.0000 |
| 71.4750 | −86.8069 | 95.0000 |
| 72.4628 | −86.2250 | 95.0000 |
| 72.9635 | −85.1934 | 95.0000 |
| 74.5131 | −84.4451 | 114.0000 |
| 70.2796 | −75.5146 | 114.0000 |
| 65.9267 | −66.6417 | 114.0000 |
| 61.4207 | −57.8456 | 114.0000 |
| 56.7229 | −49.1505 | 114.0000 |
| 51.7955 | −40.5836 | 114.0000 |
| 46.5999 | −32.1768 | 114.0000 |
| 41.0885 | −23.9739 | 114.0000 |
| 35.2071 | −16.0324 | 114.0000 |
| 28.8892 | −8.4343 | 114.0000 |
| 22.0635 | −1.2901 | 114.0000 |
| 14.6517 | 5.2421 | 114.0000 |
| 6.5938 | 10.9551 | 114.0000 |
| −2.1300 | 15.5824 | 114.0000 |
| −11.4446 | 18.8558 | 114.0000 |
| −21.1579 | 20.6245 | 114.0000 |
| −31.0285 | 20.8802 | 114.0000 |
| −40.8313 | 19.6900 | 114.0000 |
| −50.3560 | 17.0890 | 114.0000 |
| −59.2892 | 12.8978 | 114.0000 |
| −66.2640 | 6.1194 | 114.0000 |
| −66.5672 | 5.1331 | 114.0000 |
| −66.6993 | 4.1097 | 114.0000 |
| −66.6599 | 3.0784 | 114.0000 |
| −66.4538 | 2.0672 | 114.0000 |
| −66.0905 | 1.1012 | 114.0000 |
| −65.5777 | 0.2057 | 114.0000 |
| −64.9297 | −0.5977 | 114.0000 |
| −64.1643 | −1.2900 | 114.0000 |
| −63.2944 | −1.8450 | 114.0000 |
| −62.3423 | −2.2427 | 114.0000 |
| −54.1174 | −3.5857 | 114.0000 |

TABLE I-continued

| X | Y | Z |
|---|---|---|
| −45.7751 | −3.9828 | 114.0000 |
| −37.4279 | −4.2750 | 114.0000 |
| −29.1008 | −4.9058 | 114.0000 |
| −20.8507 | −6.1905 | 114.0000 |
| −12.7634 | −8.2644 | 114.0000 |
| −4.9161 | −11.1158 | 114.0000 |
| 2.6442 | −14.6603 | 114.0000 |
| 9.8900 | −18.8107 | 114.0000 |
| 16.8004 | −23.4987 | 114.0000 |
| 23.3626 | −28.6633 | 114.0000 |
| 29.5722 | −34.2472 | 114.0000 |
| 35.4360 | −40.1936 | 114.0000 |
| 40.9797 | −46.4400 | 114.0000 |
| 46.2545 | −52.9154 | 114.0000 |
| 51.3335 | −59.5459 | 114.0000 |
| 56.2997 | −66.2615 | 114.0000 |
| 61.2299 | −73.0035 | 114.0000 |
| 66.1646 | −79.7423 | 114.0000 |
| 71.1217 | −86.4647 | 114.0000 |
| 72.0458 | −87.1488 | 114.0000 |
| 73.1924 | −87.2064 | 114.0000 |
| 74.1786 | −86.6191 | 114.0000 |
| 74.6742 | −85.5835 | 114.0000 |
| 76.0760 | −83.8218 | 133.0000 |
| 71.7527 | −74.7867 | 133.0000 |
| 67.3093 | −65.8101 | 133.0000 |
| 62.7092 | −56.9128 | 133.0000 |
| 57.9068 | −48.1233 | 133.0000 |
| 52.8623 | −39.4705 | 133.0000 |
| 47.5404 | −30.9857 | 133.0000 |
| 41.8841 | −22.7204 | 133.0000 |
| 35.8366 | −14.7373 | 133.0000 |
| 29.3437 | −7.1127 | 133.0000 |
| 22.3403 | 0.0447 | 133.0000 |
| 14.7710 | 6.5996 | 133.0000 |
| 6.6169 | 12.4090 | 133.0000 |
| −2.1210 | 17.2938 | 133.0000 |
| −11.3838 | 21.0878 | 133.0000 |
| −21.0505 | 23.6850 | 133.0000 |
| −30.9709 | 25.0145 | 133.0000 |
| −40.9797 | 25.0377 | 133.0000 |
| −50.8741 | 23.5642 | 133.0000 |
| −60.2872 | 20.1958 | 133.0000 |
| −67.9113 | 13.9870 | 133.0000 |
| −68.2246 | 13.0274 | 133.0000 |
| −68.3698 | 12.0283 | 133.0000 |
| −68.3474 | 11.0189 | 133.0000 |
| −68.1673 | 10.0252 | 133.0000 |
| −67.8382 | 9.0706 | 133.0000 |
| −67.3650 | 8.1786 | 133.0000 |
| −66.7579 | 7.3717 | 133.0000 |
| −66.0307 | 6.6712 | 133.0000 |
| −65.1985 | 6.0997 | 133.0000 |
| −64.2819 | 5.6765 | 133.0000 |
| −55.9282 | 3.7024 | 133.0000 |
| −47.4200 | 2.4716 | 133.0000 |
| −38.9201 | 1.1856 | 133.0000 |
| −30.4734 | −0.4094 | 133.0000 |
| −22.1349 | −2.4939 | 133.0000 |
| −13.9750 | −5.1926 | 133.0000 |
| −6.0505 | −8.5199 | 133.0000 |
| 1.6125 | −12.4128 | 133.0000 |
| 8.9968 | −16.8118 | 133.0000 |
| 16.0887 | −21.6685 | 133.0000 |
| 22.8784 | −26.9396 | 133.0000 |
| 29.3545 | −32.5915 | 133.0000 |
| 35.5071 | −38.5943 | 133.0000 |
| 41.3347 | −44.9132 | 133.0000 |
| 46.8697 | −51.4903 | 133.0000 |
| 52.1788 | −58.2515 | 133.0000 |
| 57.3478 | −65.1207 | 133.0000 |
| 62.4623 | −72.0306 | 133.0000 |
| 67.5699 | −78.9456 | 133.0000 |
| 72.6900 | −85.8514 | 133.0000 |
| 73.6162 | −86.5345 | 133.0000 |
| 74.7640 | −86.5896 | 133.0000 |
| 75.7494 | −85.9989 | 133.0000 |
| 76.2419 | −84.9606 | 133.0000 |

TABLE I-continued

| X | Y | Z |
|---|---|---|
| 77.4161 | −82.5350 | 152.0000 |
| 72.9730 | −73.3207 | 152.0000 |
| 68.4139 | −64.1632 | 152.0000 |
| 63.6941 | −55.0875 | 152.0000 |
| 58.7659 | −46.1235 | 152.0000 |
| 53.5821 | −37.3050 | 152.0000 |
| 48.0966 | −28.6711 | 152.0000 |
| 42.2548 | −20.2746 | 152.0000 |
| 36.0019 | −12.1799 | 152.0000 |
| 29.2846 | −4.4670 | 152.0000 |
| 22.0555 | 2.7677 | 152.0000 |
| 14.2989 | 9.4331 | 152.0000 |
| 6.0202 | 15.4369 | 152.0000 |
| −2.7538 | 20.6898 | 152.0000 |
| −11.9817 | 25.0954 | 152.0000 |
| −21.6124 | 28.5297 | 152.0000 |
| −31.5788 | 30.8039 | 152.0000 |
| −41.7637 | 31.6429 | 152.0000 |
| −51.9361 | 30.7252 | 152.0000 |
| −61.6490 | 27.5977 | 152.0000 |
| −69.6190 | 21.4753 | 152.0000 |
| −69.9408 | 20.5312 | 152.0000 |
| −70.0964 | 19.5458 | 152.0000 |
| −70.0865 | 18.5483 | 152.0000 |
| −69.9217 | 17.5642 | 152.0000 |
| −69.6103 | 16.6163 | 152.0000 |
| −69.1565 | 15.7277 | 152.0000 |
| −68.5675 | 14.9226 | 152.0000 |
| −67.8558 | 14.2234 | 152.0000 |
| −67.0417 | 13.6466 | 152.0000 |
| −66.1429 | 13.2142 | 152.0000 |
| −57.6006 | 11.0356 | 152.0000 |
| −48.9245 | 9.3997 | 152.0000 |
| −40.3433 | 7.3260 | 152.0000 |
| −31.8783 | 4.8181 | 152.0000 |
| −23.5381 | 1.9225 | 152.0000 |
| −15.3665 | −1.4185 | 152.0000 |
| −7.4046 | −5.2321 | 152.0000 |
| 0.3162 | −9.5130 | 152.0000 |
| 7.7677 | −14.2470 | 152.0000 |
| 14.9381 | −19.3973 | 152.0000 |
| 21.8305 | −24.9143 | 152.0000 |
| 28.4515 | −30.7544 | 152.0000 |
| 34.8094 | −36.8802 | 152.0000 |
| 40.9141 | −43.2584 | 152.0000 |
| 46.7865 | −49.8513 | 152.0000 |
| 52.4609 | −56.6157 | 152.0000 |
| 57.9805 | −63.5070 | 152.0000 |
| 63.3941 | −70.4820 | 152.0000 |
| 68.7377 | −77.5108 | 152.0000 |
| 74.0351 | −84.5746 | 152.0000 |
| 74.9633 | −85.2566 | 152.0000 |
| 76.1123 | −85.3090 | 152.0000 |
| 77.0969 | −84.7150 | 152.0000 |
| 77.5864 | −83.6742 | 152.0000 |
| 78.6143 | −80.8080 | 171.0000 |
| 74.0477 | −71.4132 | 171.0000 |
| 69.3775 | −62.0694 | 171.0000 |
| 64.5474 | −52.8074 | 171.0000 |
| 59.5008 | −43.6618 | 171.0000 |
| 54.1815 | −34.6721 | 171.0000 |
| 48.5349 | −25.8847 | 171.0000 |
| 42.5061 | −17.3553 | 171.0000 |
| 36.0440 | −9.1497 | 171.0000 |
| 29.1031 | −1.3455 | 171.0000 |
| 21.6560 | 5.9767 | 171.0000 |
| 13.7163 | 12.7615 | 171.0000 |
| 5.3113 | 18.9604 | 171.0000 |
| −3.5255 | 24.5262 | 171.0000 |
| −12.7686 | 29.3864 | 171.0000 |
| −22.4216 | 33.3661 | 171.0000 |
| −32.4706 | 36.1907 | 171.0000 |
| −42.8241 | 37.4833 | 171.0000 |
| −53.2388 | 36.9174 | 171.0000 |
| −63.2826 | 34.1418 | 171.0000 |
| −71.5674 | 28.1229 | 171.0000 |
| −71.9000 | 27.1843 | 171.0000 |
| −72.0685 | 26.2028 | 171.0000 |

TABLE I-continued

| X | Y | Z |
|---|---|---|
| −72.0716 | 25.2068 | 171.0000 |
| −71.9157 | 24.2231 | 171.0000 |
| −71.6086 | 23.2755 | 171.0000 |
| −71.1556 | 22.3886 | 171.0000 |
| −70.5674 | 21.5847 | 171.0000 |
| −69.8594 | 20.8842 | 171.0000 |
| −69.0469 | 20.3082 | 171.0000 |
| −68.1487 | 19.8784 | 171.0000 |
| −59.3569 | 17.7342 | 171.0000 |
| −50.4831 | 15.9013 | 171.0000 |
| −41.7724 | 13.4081 | 171.0000 |
| −33.2464 | 10.3394 | 171.0000 |
| −24.8827 | 6.8514 | 171.0000 |
| −16.6843 | 2.9907 | 171.0000 |
| −8.6801 | −1.2576 | 171.0000 |
| −0.9149 | −5.9278 | 171.0000 |
| 6.5694 | −11.0361 | 171.0000 |
| 13.7605 | −16.5499 | 171.0000 |
| 20.6760 | −22.4061 | 171.0000 |
| 27.3510 | −28.5353 | 171.0000 |
| 33.8307 | −34.8710 | 171.0000 |
| 40.1622 | −41.3549 | 171.0000 |
| 46.3680 | −47.9593 | 171.0000 |
| 52.4403 | −54.6867 | 171.0000 |
| 58.3635 | −61.5455 | 171.0000 |
| 64.1322 | −68.5348 | 171.0000 |
| 69.7522 | −75.6444 | 171.0000 |
| 75.2386 | −82.8575 | 171.0000 |
| 76.1689 | −83.5379 | 171.0000 |
| 77.3187 | −83.5875 | 171.0000 |
| 78.3023 | −82.9903 | 171.0000 |
| 78.7887 | −81.9473 | 171.0000 |
| 79.8851 | −78.6935 | 190.0000 |
| 75.2268 | −69.1622 | 190.0000 |
| 70.4732 | −59.6782 | 190.0000 |
| 65.5473 | −50.2827 | 190.0000 |
| 60.3730 | −41.0219 | 190.0000 |
| 54.8882 | −31.9418 | 190.0000 |
| 49.0408 | −23.0910 | 190.0000 |
| 42.7846 | −14.5248 | 190.0000 |
| 36.0833 | −6.3023 | 190.0000 |
| 28.9158 | 1.5167 | 190.0000 |
| 21.2705 | 8.8689 | 190.0000 |
| 13.1629 | 15.7080 | 190.0000 |
| 4.6250 | 22.0015 | 190.0000 |
| −4.3238 | 27.6950 | 190.0000 |
| −13.6684 | 32.7116 | 190.0000 |
| −23.4194 | 36.8793 | 190.0000 |
| −33.5643 | 39.9604 | 190.0000 |
| −44.0214 | 41.6940 | 190.0000 |
| −54.6175 | 41.8123 | 190.0000 |
| −65.0456 | 39.9788 | 190.0000 |
| −73.7320 | 34.3910 | 190.0000 |
| −74.0822 | 33.4526 | 190.0000 |
| −74.2687 | 32.4684 | 190.0000 |
| −74.2887 | 31.4668 | 190.0000 |
| −74.1431 | 30.4757 | 190.0000 |
| −73.8401 | 29.5208 | 190.0000 |
| −73.3860 | 28.6278 | 190.0000 |
| −72.7941 | 27.8195 | 190.0000 |
| −72.0817 | 27.1152 | 190.0000 |
| −71.2602 | 26.5421 | 190.0000 |
| −70.3516 | 26.1207 | 190.0000 |
| −61.2871 | 23.9824 | 190.0000 |
| −52.1954 | 21.9329 | 190.0000 |
| −43.2579 | 19.2927 | 190.0000 |
| −34.5180 | 16.0571 | 190.0000 |
| −25.9779 | 12.3244 | 190.0000 |
| −17.6277 | 8.1840 | 190.0000 |
| −9.4862 | 3.6473 | 190.0000 |
| −1.5907 | −1.3049 | 190.0000 |
| 6.0225 | −6.6809 | 190.0000 |
| 13.3421 | −12.4507 | 190.0000 |
| 20.3837 | −18.5570 | 190.0000 |
| 27.1844 | −24.9309 | 190.0000 |
| 33.7961 | −31.5009 | 190.0000 |
| 40.2768 | −38.2004 | 190.0000 |
| 46.6555 | −44.9972 | 190.0000 |

TABLE I-continued

| X | Y | Z |
|---|---|---|
| 52.9201 | −51.8991 | 190.0000 |
| 59.0478 | −58.9227 | 190.0000 |
| 65.0246 | −66.0753 | 190.0000 |
| 70.8452 | −73.3555 | 190.0000 |
| 76.5161 | −80.7530 | 190.0000 |
| 77.4484 | −81.4304 | 190.0000 |
| 78.5981 | −81.4763 | 190.0000 |
| 79.5797 | −80.8763 | 190.0000 |
| 80.0629 | −79.8320 | 190.0000 |

An optimized parabolic curvature was followed to model the bowed shape of the vane 13 along the radial height enclosed between shroud 11 and 12. The vane turning angle has been adapted to improve flow incidence, eliminate separation and re-align the gas flow into the downstream rotary blade. The trailing edge 15 thickness was reduced to lower trailing edge loss. The leading edge 14 region was modified to make the vane 13 tolerant to wide swings in incidence. This enhances the vane's 13 long term durability by enabling the use of the vane 13 in various operating conditions without separation occurring and thereby reducing loss and heat transfer issues. The bowed shape of the airfoil profile enhances radial loading balance, reduces endwall (suction side 16 and pressure side 17) losses and delivers uniform flow to the downstream components.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A turbine vane for a turbine machine comprising an intermediate section having a nominal airfoil profile substantially in accordance with Cartesian coordinate values of X, Y and Z set forth in Table I wherein Z is a radial distance along a stacking axis that is normal to a centerline of the turbine machine and contain the X and Y values with Z value beginning at innermost aerodynamic point and the Z values represent a radial height of the vane and the X and Y values define the nominal airfoil profile at each radial height Z.

2. The turbine vane of claim 1 wherein the vane is a stationary component of a turbine stage for the turbine machine.

3. The turbine vane of claim 2 wherein the vane is a stationary component of a second turbine stage for the turbine machine.

4. The turbine vane of claim 1 wherein the X and Y values are linearly or geometrically scalable up or down as a function of the same constant or number.

5. The turbine vane of claim 1 wherein the X and Y values have a nominal profile tolerance of ±2.5 millimeters.

6. The turbine vane of claim 5 wherein the nominal airfoil profile is for an uncoated intermediate section of the turbine vane.

7. The turbine vane of claim 1 wherein the X and Y values define a set of points for each Z value which when connected by smooth continuing arcs define an airfoil profile of the intermediate section of the vane, and the profile sections at the Z heights being joined smoothly with one another to form an airfoil shape of the intermediate portion.

8. A stationary turbine vane for a turbine machine comprising a contoured uncoated intermediate section for controlling gas flow through a turbine vane block on which the stationary vane is mounted and the intermediate section having a nominal airfoil profile substantially in accordance with Cartesian coordinate values of X, Y and Z set forth in Table I wherein Z is a radial distance along a stacking axis that is normal to a centerline of the turbine machine and contain the X and Y values with Z value beginning at zero at an innermost aerodynamic point and the Z values represent a radial height of the vane and the X and Y values define the nominal airfoil profile at each radial height Z, and the X and Y values have a nominal profile tolerance of ±2.5 millimeters.

9. The stationary turbine vane of claim 8 wherein the X and Y values are linearly or geometrically scalable up or down as a function of the same constant or number.

10. The stationary turbine vane of claim 9 wherein the intermediate section has a leading edge disposed toward a gas flow ingress to the turbine block, a trailing edge disposed toward a gas flow egress to the turbine block, a pressure side disposed between the leading edge and trail edge and a suction side opposite the pressure side.

11. The stationary turbine vane of claim 8 wherein the X and Y values define a set of points for each Z value which when connected by smooth continuing arcs define an airfoil profile of the intermediate section of the vane, and the profile sections at the Z heights being joined smoothly with one another to form an airfoil shape of the intermediate portion.

12. The stationary turbine vane of claim 8 wherein the turbine vane block is a component of a second stage of a turbine machine.

13. A turbine machine comprising at least one stage including a turbine vane block positioned upstream a gas flow relative to a turbine blade block, wherein the turbine vane block includes a plurality of stationary vanes circumferentially spaced about a rotating shaft of the turbine machine to control gas flow from a compressor and combustor to the turbine blade block, and each stationary vane comprises an intermediate having a nominal airfoil profile substantially in accordance with Cartesian coordinate values of X, Y and Z set forth in Table I wherein Z is a radial height along a stacking axis that is normal to a centerline of the turbine machine and contain the X and Y values with Z value beginning at zero at an innermost aerodynamic point and the Z values represent a radial height of the vane and the X and Y values define the nominal airfoil profile at each radial height Z.

14. The turbine machine of claim 13 wherein the turbine includes multiple stages and the turbine vanes are a component of a second stage of the turbine machine.

15. The turbine machine of claim 13 wherein the X and Y values of the nominal airfoil profile are linearly or geometrically scalable up or down as a function of the same constant or number.

16. The turbine machine of claim 13 wherein the X and Y values of the nominal airfoil profile have a nominal profile tolerance of ±2.5 millimeters.

17. The turbine machine of claim 16 wherein the nominal airfoil profile is for an uncoated intermediate section of the turbine vane.

18. The turbine machine of claim 13 wherein the X and Y values define a set of points for each Z value which when connected by smooth continuing arcs define an airfoil profile of the intermediate section of the vane, and the profile sections at the Z heights being joined smoothly with one another to form an airfoil shape of the intermediate portion.

* * * * *